US009556558B2

(12) United States Patent
Pylkkanen et al.

(10) Patent No.: US 9,556,558 B2
(45) Date of Patent: Jan. 31, 2017

(54) PROCESSES FOR PRODUCING HIGH-YIELD PULP AND PAPER PRODUCTS

(71) Applicant: API Intellectual Property Holdings, LLC, Atlanta, GA (US)

(72) Inventors: Vesa Pylkkanen, Atlanta, GA (US); Theodora Retsina, Atlanta, GA (US)

(73) Assignee: API Intellectual Property Holdings, LLC, Atlanta, GA (US)

( * ) Notice: Subject to any disclaimer, the term of this patent is extended or adjusted under 35 U.S.C. 154(b) by 0 days.

(21) Appl. No.: 14/590,681

(22) Filed: Jan. 6, 2015

(65) Prior Publication Data

US 2015/0191873 A1 Jul. 9, 2015

Related U.S. Application Data

(60) Provisional application No. 61/924,465, filed on Jan. 7, 2014.

(51) Int. Cl.

| | |
|---|---|
| ***D21C 1/02*** | (2006.01) |
| ***D21C 9/02*** | (2006.01) |
| ***D21C 11/10*** | (2006.01) |
| ***D21B 1/02*** | (2006.01) |
| ***D21H 11/08*** | (2006.01) |
| *D21C 11/00* | (2006.01) |

(52) U.S. Cl.

CPC ..... *D21C 11/10* (2013.01); *D21B 1/021* (2013.01); *D21C 1/02* (2013.01); *D21C 9/02* (2013.01); *D21C 11/0007* (2013.01); *D21H 11/08* (2013.01); *D21C 11/0042* (2013.01)

(58) Field of Classification Search

CPC ..... D21C 1/02; D21C 11/0042; D21C 11/10; D21C 9/02; D21C 9/04; D21C 9/06; D21B 1/021

See application file for complete search history.

(56) References Cited

U.S. PATENT DOCUMENTS 6,514,379 B1 * 2/2003 Gartz ..... D21C 11/0021 162/189
7,771,565 B2 * 8/2010 Kirov ..... D21B 1/16 162/23

OTHER PUBLICATIONS

McGovern et al., Experiments on Water and Steam Cooking of Aspen,1949, TAPPI, vol. 32, No. 10, p. 440-448.*

(Continued)

*Primary Examiner* — Anthony Calandra
(74) *Attorney, Agent, or Firm* — Ryan P. O'Connor

(57) ABSTRACT

An improved semichemical pulping process is disclosed to reduce washing costs and recovery process costs, while producing equivalent pulp and paper products. In some variations, the invention provides a process for producing a paper product from biomass, comprising: digesting lignocellulosic biomass in the presence of steam and/or hot water to generate an intermediate pulp material and a liquid phase containing extracted hemicelluloses; mechanically refining the intermediate pulp material, to generate a refined pulp material; and introducing the refined pulp material, the liquid phase, and optionally a separate solid material to a paper machine, to produce a paper product. The process optionally employs no washing step. When the liquid phase is washed from the intermediate pulp material or the refined pulp material using an aqueous wash solution, the wash filtrate may be introduced directly or indirectly to the paper machine.

12 Claims, 1 Drawing Sheet

(56) References Cited

OTHER PUBLICATIONS

Smook, Handbook for Pulp and Paper Technologists, 1992, Angus Wilde Publications, 2nd edition, chapters 11, 13, 15, and 16.*
Smook, Handbook for Pulp and Paper Technologists, 1992, Angus Wilde Publications, 2nd edition, chapter 5.*

* cited by examiner

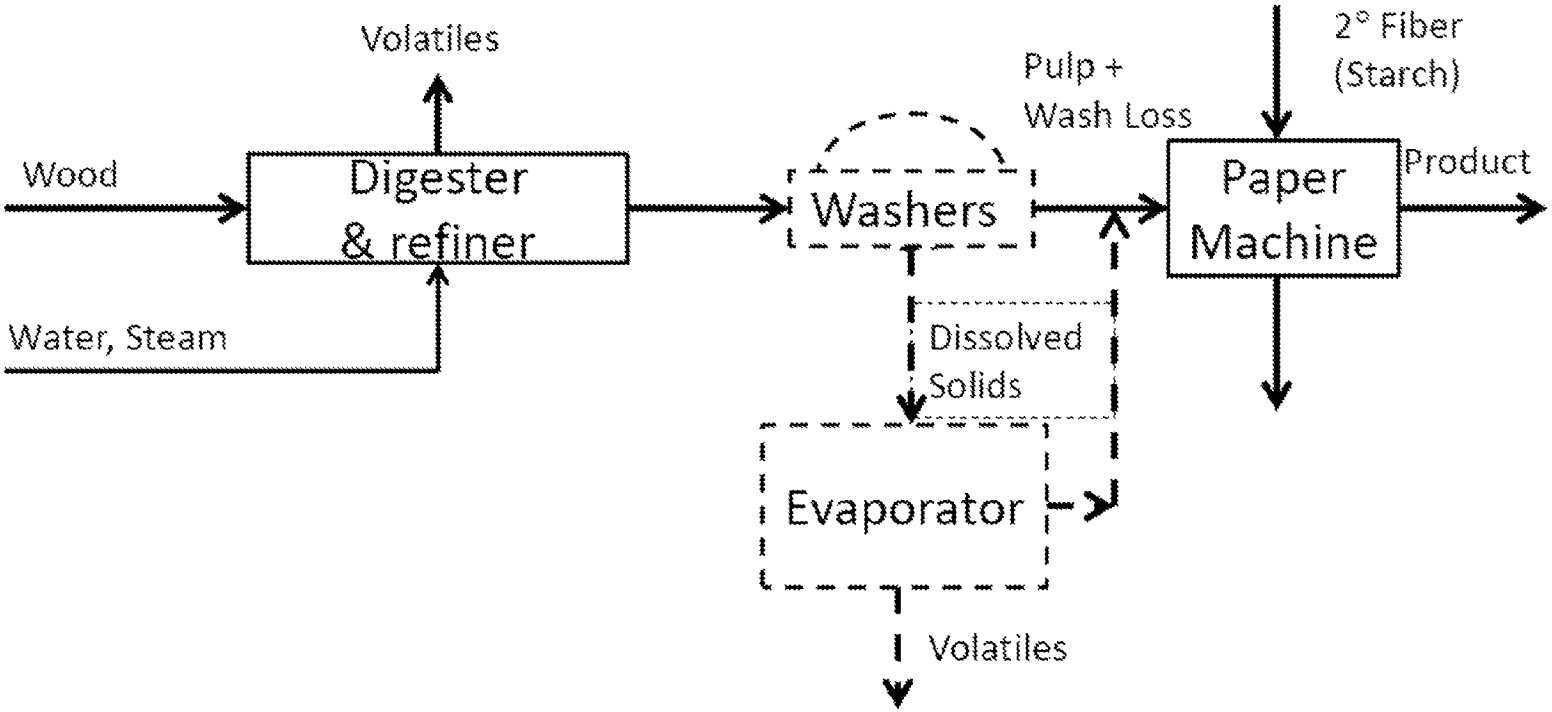
Wood
Water, Steam
Digester & refiner
Volatiles
Washers
Pulp + Wash Loss
Dissolved Solids
Evaporator
Volatiles
Paper Machine
2° Fiber (Starch)
Product

PROCESSES FOR PRODUCING HIGH-YIELD PULP AND PAPER PRODUCTS

PRIORITY DATA

This patent application is a non-provisional application claiming priority to U.S. Provisional Patent App. No. 61/924,465, filed Jan. 7, 2014, which is hereby incorporated by reference herein.

FIELD

The present invention generally relates to improved processes for producing cellulose pulp and paper products.

BACKGROUND

Wood and biomass have been converted to paper and packaging carton products by chemical pulping methods since 1864. The aim of chemical pulping is to delignify biomass and release fibrous cellulose material. Cellulose is composed of straight glucose chains consisting of several thousand units. These fibers are extremely strong, but only 1-3 millimeters long and only nanometers wide. When fibers are formed on a flat surface and dewatered, the intertwined fibers create a mat of pulp or paper sheet. The strength of a sheet from pure cellulosic fibers is weak due to lack of chemical bonding.

The hemicelluloses are short chains of only few hundred monomer units. The hemicelluloses consist of heterogeneous chains of sugars including glucose, xylose, mannose, arabinose, galactose, and rhamnose. In addition, the some hemicellulose side chains terminate in acetyl groups, which gives them functional properties. The hemicelluloses bond between the cellulose fibers creating a strong network, a fundamental property of paper. Other hemicellulosic components, such as uronic acids, are not desirable because they cause chemical consumption in pulping and bleaching.

Commercial paper machines form paper in a continuous forming table, named after Fourdrinier. Because the table is moving at ever-increasing speeds, the fibers orient in the machine direction giving more strength than the cross-machine direction. Higher hemicellulose content increases the strength in both directions. In some cases, the bonding is increased by adding starch in the Fourdrinier or on the dried paper sheet. Starch is a sugar polymer of vegetable origin.

Pulping processes are broadly divided into mechanical, semichemical, and chemical methods differing in pulp yield. Chemical pulping dissolves about half of the original material to release bleachable cellulose. This dissolved material is commonly burned to recover chemical used in the pulping. Alkaline pulping chemicals include sodium hydroxide, sodium carbonate, and sodium sulfide in different variations. Acid-based pulping chemicals include sulfur dioxide as sodium sulfite, ammonium sulfite, calcium bisulfite, and magnesium bisulfite in acid-sulfite pulping.

Mechanical pulping utilizes grinding wood or woodchips by mechanical means. An example is the stone groundwood process, where a complete wood log is ground to fine powder with nearly 100% yield. This requires large amount of electricity, such as 1500 to 2500 kWh per ton of wood. Thermomechanical pulping systems incorporate a short presteaming step before disk refining of wood chips.

Semichemical pulping is a compromise between chemical and mechanical pulping. The yield is typically 75-85% from a 10-60 minute cook. The aim is to soften the wood chips enough to significantly reduce refining energy, while maintaining the hemicelluloses in the pulp. A portion of lignin is dissolved in the sodium-based or ammonium-based processes. The process may include acidic, neutral, or alkaline pulping conditions. Sulfur dioxide in the form of ammonium sulfite or sodium sulfite may be used in the neutral and acidic processes. Sodium hydroxide or sodium carbonate may be used in alkaline processes.

In semichemical pulping, wood chips are first subjected to mild cooking in, most commonly, sodium sulfite combined with a small quantity of alkaline salts, such as sodium carbonate, sodium bicarbonate, or sodium hydroxide. The cooked chips are then sandwiched in a disk refiner—or two rotating serrated disks—that separate the individual fibers of cellulose. The pulp is then washed to remove the chemicals.

Semichemical pulping is commonly performed in a continuous digester in the absence of free liquid. This is called "vapor phase" digesting. Washing is performed in 2-5 stages to remove 70-95% of the dissolved solids from the pulp. This is important for economic and environmental reasons. The digester and washers present approximately half of the pulp plant cost.

The pulp from semichemical pulping is used for packaging products, especially for corrugating medium in box plants. Semichemical pulping results in stiff fibers, and the process is used to make corrugated paperboard, cardboard roll cores, and containers. Important physical properties include crush resistance of the corrugators. Preferred fiber sources are hardwood and bagasse, which contain shorter fibers. The hemicelluloses are retained to add bulk and strength from bonding. Lignin removal is not necessary for unbleached products. Higher yields are preferred to reduce cost of fiber.

The semichemical pulping spent liquor contains reacted cooking chemicals and dissolved wood components. The combustion of this liquor is practiced to recover chemicals and to produce energy for the process. Due to high pulping yield, the amount of energy recovered is less than energy needed for processing the liquor. In some cases, no process energy is produced, or in extreme cases, chemicals are not recovered. The sodium is typically recycled by combusting in a recovery boiler. The sulfur dioxide from ammonium sulfite can be recycled from flue gases after combustion of the spent liquor. In either case, the recovery process present about half of the pulping plant cost.

What are desired are improvements to semichemical pulping processes to reduce washing costs, recovery process costs, and overall process costs, while producing equivalent pulp and paper products.

SUMMARY

In some variations, the invention provides a process for producing a paper product from biomass, the process comprising:

(a) providing lignocellulosic biomass comprising cellulose, hemicellulose, and lignin;

(b) digesting the biomass in the presence of steam and/or hot water to generate an intermediate pulp material and a liquid phase, wherein the liquid phase contains extracted hemicelluloses;

(c) mechanically refining the intermediate pulp material, to generate a refined pulp material; and (d) introducing the refined pulp material, the liquid phase or a derivative thereof, and optionally a separate solid material to a paper machine, to produce a paper product.

In some embodiments, step (b) is conducted using the steam in saturated, superheated, or supersaturated form. In some embodiments, step (b) is conducted using liquid hot water. Step (b) may be conducted at a digestor temperature selected from about 140° C. to about 220° C. and a digestor residence time selected from about 1 minute to about 60 minutes, for example.

In some embodiments, the process further comprises washing the liquid phase from the intermediate pulp material using an aqueous wash solution, to generate a wash filtrate. The wash filtrate may be introduced directly or indirectly to the paper machine. In these or other embodiments, the process further comprises washing the liquid phase from the refined pulp material using an aqueous wash solution, to generate a wash filtrate. Again, this wash filtrate may be introduced directly or indirectly to the paper machine.

In some embodiments, the intermediate pulp material is not separately washed (i.e., using a wash solution distinct from the liquid phase). In these or other embodiments, the refined pulp material is not separately washed (i.e., using a wash solution distinct from the liquid phase).

Some variations provide a process for producing a pulp product from biomass, the process comprising:

(a) providing lignocellulosic biomass comprising cellulose, hemicellulose, and lignin;

(b) digesting the biomass in the presence of steam and/or hot water to generate an intermediate pulp material and a liquid phase, wherein the liquid phase contains extracted hemicelluloses;

(c) mechanically refining the intermediate pulp material, to generate a refined pulp material; and (d) combining the refined pulp material, the liquid phase or a derivative thereof, and optionally a separate solid material, to produce a pulp product.

In some processes, step (b) is conducted using steam in saturated, superheated, or supersaturated form, or using liquid hot water. Step (b) may be conducted, for example, at a digestor temperature selected from about 140° C. to about 220° C. and a digestor residence time selected from about 1 minute to about 60 minutes.

In some embodiments, the process further comprises washing the liquid phase from the intermediate pulp material using an aqueous wash solution, to generate a wash filtrate. In some embodiments, the process further comprises washing the liquid phase from the refined pulp material using an aqueous wash solution, to generate a wash filtrate.

The intermediate pulp material, in some embodiments, is not separately washed. The refined pulp material, in some embodiments, is not separately washed.

Some variations provide a pulp product (such as a semi-chemical pulp) produced by a process comprising:

(a) providing lignocellulosic biomass comprising cellulose, hemicellulose, and lignin;

(b) digesting the biomass in the presence of steam and/or hot water to generate an intermediate pulp material and a liquid phase, wherein the liquid phase contains extracted hemicelluloses;

(c) mechanically refining the intermediate pulp material, to generate a refined pulp material; and (d) combining the refined pulp material, the liquid phase or a derivative thereof, and optionally a separate solid material, to produce a pulp product.

Some variations provide a paper product produced by a process comprising:

(a) providing lignocellulosic biomass comprising cellulose, hemicellulose, and lignin;

(b) digesting the biomass in the presence of steam and/or hot water to generate an intermediate pulp material and a liquid phase, wherein the liquid phase contains extracted hemicelluloses;

(c) mechanically refining the intermediate pulp material, to generate a refined pulp material; and (d) introducing the refined pulp material, the liquid phase or a derivative thereof, and optionally a separate solid material to a paper machine, to produce a paper product.

BRIEF DESCRIPTION OF THE FIGURE

FIG. 1 is a high-level block-flow diagram according to some embodiments of the invention (dotted lines indicate optional streams and unit operations).

DETAILED DESCRIPTION OF SOME EMBODIMENTS

This description will enable one skilled in the art to make and use the invention, and it describes several embodiments, adaptations, variations, alternatives, and uses of the invention. These and other embodiments, features, and advantages of the present invention will become more apparent to those skilled in the art when taken with reference to the following detailed description of the invention in conjunction with any accompanying drawings.

As used in this specification and the appended claims, the singular forms "a," "an," and "the" include plural referents unless the context clearly indicates otherwise. Unless defined otherwise, all technical and scientific terms used herein have the same meaning as is commonly understood by one of ordinary skill in the art to which this invention belongs. All composition numbers and ranges based on percentages are weight percentages, unless indicated otherwise. All ranges of numbers or conditions are meant to encompass any specific value contained within the range, rounded to any suitable decimal point.

Unless otherwise indicated, all numbers expressing reaction conditions, stoichiometries, concentrations of components, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" limits the scope of a claim to the specified elements or method steps, plus those that do not materially affect the basis and novel characteristic(s) of the claimed subject matter.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of"

The present invention is premised on a rapid hot-water-based cooking method, where lignin and cellulose are retained in the pulp. Dissolved hemicelluloses are either minimized, or if extracted are returned to the pulp, to maintain good pulp yield and desirable corrugating medium properties. Optionally, a portion of the dissolved hemicelluloses may be used for alternate bio-based products (e.g., ethanol or other fermentation products). The process eliminates a washing unit and a chemical recovery plant, in some embodiments. FIG. 1 depicts exemplary embodiments and principles of the invention.

In some variations, the invention provides a process for producing a paper product from biomass, the process comprising:

(a) providing lignocellulosic biomass comprising cellulose, hemicellulose, and lignin;

(b) digesting the biomass in the presence of steam and/or hot water to generate an intermediate pulp material and a liquid phase, wherein the liquid phase contains extracted hemicelluloses;

(c) mechanically refining the intermediate pulp material, to generate a refined pulp material; and (d) introducing the refined pulp material, the liquid phase or a derivative thereof, and optionally a separate solid material to a paper machine, to produce a paper product.

In some embodiments, step (b) is conducted using the steam in saturated, superheated, or supersaturated form. In some embodiments, step (b) is conducted using liquid hot water. Step (b) may be conducted at a digestor temperature selected from about 140° C. to about 220° C. and a digestor residence time selected from about 1 minute to about 60 minutes, for example.

In some embodiments, the process further comprises washing the liquid phase from the intermediate pulp material using an aqueous wash solution, to generate a wash filtrate. The wash filtrate may be introduced directly or indirectly to the paper machine. For example, the wash filtrate may be fed to the paper machine, or the wash filtrate may be combined with the liquid phase and/or the solids entering the paper machine, or with a separate solid material introduced to the paper machine.

In these or other embodiments, the process further comprises washing the liquid phase from the refined pulp material using an aqueous wash solution, to generate a wash filtrate. Again, this wash filtrate may be introduced directly or indirectly to the paper machine, as described above.

In some embodiments, the intermediate pulp material is not separately washed (i.e., there is no wash solution distinct from the liquid phase). In these or other embodiments, the refined pulp material is not separately washed (i.e., there is no wash solution distinct from the liquid phase). As depicted in FIG. 1, the washer unit operation is optional.

Some variations provide a process for producing a pulp product from biomass, the process comprising:

(a) providing lignocellulosic biomass comprising cellulose, hemicellulose, and lignin;

(b) digesting the biomass in the presence of steam and/or hot water to generate an intermediate pulp material and a liquid phase, wherein the liquid phase contains extracted hemicelluloses;

(c) mechanically refining the intermediate pulp material, to generate a refined pulp material; and (d) combining the refined pulp material, the liquid phase or a derivative thereof, and optionally a separate solid material, to produce a pulp product.

In some processes, step (b) is conducted using steam in saturated, superheated, or supersaturated form, or using liquid hot water. Step (b) may be conducted, for example, at a digestor temperature selected from about 140° C. to about 220° C. and a digestor residence time selected from about 1 minute to about 60 minutes.

In some embodiments, the process further comprises washing the liquid phase from the intermediate pulp material using an aqueous wash solution, to generate a wash filtrate. In some embodiments, the process further comprises washing the liquid phase from the refined pulp material using an aqueous wash solution, to generate a wash filtrate.

The intermediate pulp material, in some embodiments, is not separately washed. The refined pulp material, in some embodiments, is not separately washed.

Some variations provide a pulp product (such as a semi-chemical pulp) produced by a process comprising:

(a) providing lignocellulosic biomass comprising cellulose, hemicellulose, and lignin;

(b) digesting the biomass in the presence of steam and/or hot water to generate an intermediate pulp material and a liquid phase, wherein the liquid phase contains extracted hemicelluloses;

(c) mechanically refining the intermediate pulp material, to generate a refined pulp material; and (d) combining the refined pulp material, the liquid phase or a derivative thereof, and optionally a separate solid material, to produce a pulp product.

Some variations provide a paper product produced by a process comprising:

(a) providing lignocellulosic biomass comprising cellulose, hemicellulose, and lignin;

(b) digesting the biomass in the presence of steam and/or hot water to generate an intermediate pulp material and a liquid phase, wherein the liquid phase contains extracted hemicelluloses;

(c) mechanically refining the intermediate pulp material, to generate a refined pulp material; and (d) introducing the refined pulp material, the liquid phase or a derivative thereof, and optionally a separate solid material to a paper machine, to produce a paper product.

In some embodiments, the process starts as biomass (e.g., wood chips or bagasse) is received or reduced to approximately 1" length. In the first step of the process, the biomass chips are fed to a pressurized vessel operating continuously or in batch mode. The chips may be steamed or water washed to remove dirt and entrained air. The chips are impregnated with hot water and heated to between 100° C. and 250° C., for example 150° C., 160° C., 170° C., 180° C., 190° C., 200° C. or 210° C. or most preferably 170° C. to 190° C. The digester heat may be maintained with pressurized steam directly or indirectly.

The second step consists of refining and depressurization of the cooked chips. The refining may be done before or after depressurizing using disk refiners, for example. The vapors from a flash tank may be used for heating the incoming biomass or cooking liquor, directly or indirectly. The volatilized organic acids, which are generated or included in the cooking step, may be recovered.

The third step consists of washing the refined pulp. The washing may be accomplished with water, recycled condensates, RO permeate, or a combination thereof. A countercurrent configuration may be used to maximize the extract concentration. Washing removes most of the dissolved material, including hemicelluloses. Hemicelluloses may be added in the paper machine after additional refining of the pulp. In some preferred embodiments, the washing step is eliminated, and pulp along with a liquid phase containing dissolved solids is sent directly to the paper machine stock preparation.

The fourth step consists of drying of the pulp in the paper machine to the final moisture. The paper may include secondary fibers, starch, or other additives to add desired strength properties or to adjust other properties. Fresh water introduction should be minimized to avoid loss of hemicelluloses in the overflow of white water.

The biomass feedstock may be selected from hardwoods, softwoods, forest residues, industrial wastes, consumer wastes, or combinations thereof. Exemplary biomass feedstocks include maple, birch, and aspen. Some embodiments utilize agricultural residues, which include lignocellulosic biomass associated with food crops, annual grasses, energy crops, or other annually renewable feedstocks. Exemplary agricultural residues include, but are not limited to, corn stover, corn fiber, wheat straw, sugarcane bagasse, rice straw, oat straw, barley straw, miscanthus, energy cane, or combinations thereof.

In some embodiments, step (b) is conducted at a digestor temperature selected from about 140° C. to about 220° C., such as from about 170° C. to about 190° C. In some embodiments, step (b) is conducted at a digestor residence time selected from about 1 minute to about 60 minutes, such as from about 2 minutes to about 10 minutes.

In some embodiments, step (b) is conducted at a digestor pH from about 2 to about 6, such as from about 3 to about 5. In various embodiments, the refining pH is selected from about 5 to about 9, such as about 6 to about 8, or about 6.5 to about 7.5. The refining pH will generally be higher than the digestor pH, following pH adjustment with a suitable base. It is possible, however, for the digestor pH to be higher than the refining pH, or for the digestor pH and refining pH to be similar.

In certain embodiments, step (b) comprises introducing a sulfur-containing compound selected from the group consisting of sulfur dioxide, sulfurous acid, sulfuric acid, lignosulfonic acid, and combinations or derivatives thereof. In these embodiments, the digestor pH may be less than 2, such as about 1.5, 1, 0.5, 0 or less.

The pulp yield on biomass may vary from about 75% to about 95% (or higher) by weight. The yield is the fraction of starting solids remaining after pulping and washing, on a dry basis. In some embodiments, the pulp yield on biomass is at least 85% or at least 90% by weight. In certain embodiments that target mild extraction of hemicelluloses, the pulp yield on biomass is higher than 95%, such as about 96%, 97%, 98%, or 99% by weight. When the biomass yield is high, relatively little hemicelluloses are extracted—or if extracted, are returned to the pulp downstream).

The pulp from any of the disclosed processes may be characterized by a concora of about 25 lbf or higher, such as about 26, 27, 28, 29, 30, 31, 32, 33, 34, 35, 36, 37 lbf or higher. The pulp from any of the disclosed processes may be characterized by a ring crush strength of about 25 (lbf/6 in) or higher, such as about 40 (lbf/6 in) or higher. The pulp from any of the disclosed processes may be characterized by a breaking length of about 2.0 km or higher, such as about 2.1, 2.2, 2.3, 2.4, 2.5, 2.6, 2.7, 2.8, 2.9, 3.0, 3.1, 3.2, 3.3, 3.4, 3.5, 3.6 km or higher.

The invention provides pulp intermediates or products produced by processes as described. Using well-known techniques, consumer products (e.g., paper or corrugated medium) may be produced from the pulp intermediate or product. See, for example, Twede and Selke, "Cartons, crates and corrugated board: handbook of paper and wood packaging technology," DEStech Publications, pages 41-56, 2005; and Foster, "Boxes, Corrugated" in The Wiley Encyclopedia of Packaging Technology, 1997, eds. Brody A and Marsh K, 2nd ed.

In some embodiments employing washing, washing utilizes fresh water. In these or other embodiments, washing may utilize recycled water, which is preferably alkali-free recycled water to reduce or avoid alkaline degradation of sugars. "Alkali-free recycled water" means that no alkali metal, or a base, salt, or derivative thereof (e.g., sodium hydroxide or potassium chloride) is introduced into the recycled water prior to use for washing. If desired, the pH of the wash water may be adjusted or maintained in the range of about 4 to 9, such as about 4.5, 5, 5.5, 6, 6.5, 6.6, 6.7, 6.8, 6.9, 7.0, 7.1, 7.2, 7.3, 7.4, 7.5, 8, or 8.5. For example, a fresh water source at a pH of about 8 may be adjusted with an acid to a pH of about 6 for washing. Or a recycled water stream at a pH of about 4 may be adjusted to a pH of about 7 for washing.

In some embodiments, steps (b) and (c) are carried out in a single unit. For example, a continuous countercurrent unit may be configured for both digestion and refining of solids. Multiple units may be employed in parallel, where each unit is configured for both digestion and refining. Or, a first unit may be configured for only digestion, with a downstream unit (in series) configured for both digestion and refining. Or, a first unit may be configured for both digestion and refining, followed by a downstream refiner (e.g., disk refiner). Many variations are possible.

The liquid phase and a liquid wash filtrate may be separately processed. Alternatively, the liquid phase and the liquid wash filtrate may be combined. In some embodiments, the liquid phase (from digestion) forms part of the liquid wash filtrate. That is, the digestor liquor may be fed forward, without solid-liquid separation. Additional wash water may be added, depending on the desired amount of washing and the washing efficiency of the washing unit (if present).

Optionally, at least a portion of the pulp may be hydrolyzed to generate glucose. For example, pulp having inferior properties (such as fiber length or strength) may be hydrolyzed to glucose using cellulase enzymes or an acid catalyst (e.g., sulfuric acid). In some embodiments, the entire pulp product is hydrolyzed to glucose to maximize sugar production, either as a transient operation or as a steady-state operation.

Optionally, a portion of extracted hemicelluloses is converted to fermentable sugars, by hydrolyzing (with water) the soluble oligomers into monomers. In some embodiments, the hydrolysis catalyst comprises one or more compounds selected from the group consisting of sulfur dioxide, sulfurous acid, sulfuric acid, lignosulfonic acid, and combinations or derivatives thereof. In other embodiments, the hydrolysis catalyst comprises hemicellulase enzymes or other enzymes capable of catalyzing hydrolysis of hemicellulose.

The hemicellulosic sugars may be recovered in purified form, as a sugar slurry or dry sugar solids, for example. Any known technique may be employed to recover a slurry of sugars or to dry the solution to produce dry sugar solids. Thus the invention provides hemicellulosic sugar intermediates or products produced by the disclosed processes. In certain embodiments, the extracted hemicellulose stream is combusted for energy, or discarded.

Fermentation products may be produced from the hemicellulosic sugar intermediates or products. In some embodiments, the hemicellulose sugars are fermented to ethanol, 1-butanol, isobutanol, acetic acid, lactic acid, succinic acid, or any other fermentation product. A purified product may be produced by distillation, which will also generate a distillation bottoms stream containing residual solids. A bottoms evaporation stage may be used, to produce residual solids. Residual solids (such as distillation bottoms) may be recovered, or burned to produce energy for the process.

In some embodiments, the process further comprises recovering an acetate co-product, such as potassium acetate or sodium acetate. The process may include evaporation of hydrolysate to remove some or most of the volatile acids. The evaporation step is preferably performed below the acetic acid dissociation pH of 4.8, such as about 1.0, 1.5, 2.0, 2.5, 3.0, 3.5, 4.0, or 4.5. In certain embodiments, the process further comprises combining, at a pH of about 4.8 to 10 or higher, a portion of the vaporized acetic acid with an alkali oxide, alkali hydroxide, alkali carbonate, and/or alkali bicarbonate, wherein the alkali is selected from the group consisting of potassium, sodium, magnesium, calcium, and combinations thereof, to convert the portion of the vaporized acetic acid to an alkaline acetate. The alkaline acetate may be recovered by reverse osmosis or other membrane separation or filtration (see, for example, U.S. Pat. No. 8,211,680 which is incorporated by reference). If desired, purified acetic acid may be generated from the alkaline acetate. Acetic acid and acetate salts have a number of known commercial uses.

Some embodiments also recover a furfural co-product. When furfural is desired, the conditions of the initial extraction and/or the hemicellulose hydrolysis may be more severe (compared to sugars production) so that $C_5$ sugars are converted to furfural. Under conditions of heat and acid, xylose and other five-carbon sugars undergo dehydration, losing three water molecules to become furfural ($C_5H_4O_2$). Hydrogenation of furfural provides furfuryl alcohol, which is a useful chemical intermediate and which may be further hydrogenated to tetrahydrofurfuryl alcohol. Furfural is used to make other furan chemicals, such as furoic acid, via oxidation, and furan via decarbonylation.

In some embodiments, additional evaporation steps may be employed. These additional evaporation steps may be conducted at different conditions (e.g., temperature, pressure, and pH) relative to the first evaporation step.

Some embodiments employ reaction conditions and operation sequences described in U.S. Pat. Nos. 8,211,680, issued Jul. 3, 2012; 8,518,672, issued Aug. 27, 2013; 8,518,213 issued Aug. 27, 2013; 8,679,364, issued Mar. 25, 2014; 8,685,685, issued Apr. 1, 2014; 8,785,155, issued Jul. 22, 2014; 8,845,923, issued Sep. 30, 2014; 8,906,657, issued Dec. 9, 2014; U.S. patent application Ser. No. 14/044,784; or U.S. patent application Ser. No. 14/044,790. Each of these commonly owned patents and patent applications is hereby incorporated by reference herein in its entirety.

Effective "hot-water extraction" (or "HWE") conditions may include contacting the lignocellulosic biomass with steam (at various pressures in saturated, superheated, or supersaturated form) and/or hot water. In some embodiments, the HWE step is carried out using liquid hot water at a temperature from about 140-220° C., such as about 150° C., 160° C., 170° C., 175° C., 180° C., 185° C., 190° C., 200° C., or 210° C. In some embodiments, the HWE step is carried out using liquid hot water with a residence time from about 1 minute to about 60 minutes, such as about 2, 2.5, 3, 3.5, 4, 5, 7.5, 10, 12.5, 15, 20, 25, 30, 35, 40, 45, 50, or 55 minutes.

In some embodiments, washing of HWE pulp is performed using fresh water. In some embodiments, washing of HWE pulp is performed using recycled water that does not contain significant quantities of alkali. The absence of significant quantities of alkaline components reduces or avoids caustic degradation of sugars.

HWE pulping typically will produce digested solids in liquid with a pH of about 3 to 5, such as from about 3.5 to 4.5. In some embodiments, following HWE pulping, the pH of the pulp is adjusted prior to refining of the solids. In certain embodiments, the pH is adjusted to neutral or near-neutral pH, such as pH selected from about 5 to about 9, preferably about 6.5-7.5, more preferably about 6.8-7.2. The pH adjustment may be accomplished by any known means, such as (but not limited to) treatment with sodium hydroxide or ammonia.

The HWE pulp obtained may be combined with another biomass source prior to downstream processing. For example, the HWE pulp may be combined with recycled fiber (e.g., OCC or old corrugated container pulp) and then fed to a paper machine, in some embodiments. Or, the HWE pulp may be combined with a NSSC pulp, soda pulp, sulfite pulp, Kraft pulp, AVAP® pulp, or another pulp for further processing.

In some embodiments, the process further comprises removing a vapor stream comprising water and vaporized acetic acid from the extract liquor in at least one evaporation stage at a pH of 4.8 or less, to produce a concentrated extract liquor comprising the fermentable hemicellulosic sugars. At least one evaporation stage is preferably operated at a pH of 3.0 or less.

The process may further comprise a step of fermenting the fermentable hemicellulosic sugars to a fermentation product. The fermentation product may be ethanol, 1-butanol, isobutanol, or any other product (fuel or chemical). Some amount of the fermentation product may be growth of a microorganism or enzymes, which may be recovered if desired.

In some embodiments, the fermentable hemicellulose sugars are recovered from solution, in purified form. In some embodiments, the fermentable hemicellulose sugars are fermented to produce of biochemicals or biofuels such as (but by no means limited to) ethanol, 1-butanol, isobutanol, acetic acid, lactic acid, or any other fermentation products. A purified fermentation product may be produced by distilling the fermentation product, which will also generate a distillation bottoms stream containing residual solids. A bottoms evaporation stage may be used, to produce residual solids.

Pentose sugars can react to produce furfural. Under conditions of heat and acid, xylose and other five-carbon sugars undergo dehydration, losing three water molecules to become furfural ($C_5H_4O_2$). Furfural is an important renewable, non-petroleum based, chemical feedstock. Hydrogenation of furfural provides furfuryl alcohol, which is a useful chemical intermediate and which may be further hydrogenated to tetrahydrofurfuryl alcohol. Furfural is used to make other furan chemicals, such as furoic acid, via oxidation, and furan via decarbonylation. Generally speaking, process conditions that may be adjusted to promote furfural include, in one or more reaction steps, temperature, pH or acid concentration, reaction time, catalysts or other additives (e.g. $FeSO_4$), reactor flow patterns, and control of engagement between liquid and vapor phases.

In some embodiments, the process further comprises recovering the lignin as a co-product, either in combination with a salt such as gypsum, or in substantially pure form.

Process integration may be carried out for any of the disclosed processes or configurations. In some embodiments, process integration includes pinch analysis and energy optimization involving one or more steps (including all steps) in the process.

For example, evaporator condensates may be recycled for use in one or more washing steps, and/or as part of the digestor cooking liquor. In some embodiments, evaporator condensates may be recycled to a reverse osmosis unit configured for recovering alkaline acetates. Process integration may also be conducted with downstream papermaking operations.

In some embodiments, process integration includes concentrating fermentable sugars, recovering a condensate stream therefrom, and introducing the condensate stream to another location with a water requirement, such as washing, filter regeneration, or fermentation. The other location may be upstream or downstream of the condensate stream, or may even be at a co-located site.

In some embodiments, process integration includes sterilizing a fermentor or fermentor feed stream with a vapor take-off from one or more evaporators used for concentrating the fermentable sugars and/or one or more evaporators used for concentrating the fermentation product. In some embodiments, process integration includes pre-cooling a fermentor feed stream with a product stream comprising the fermentation product.

In some embodiments, process integration includes concentrating the fermentation product in a non-externally-heated effect of a multiple-effect evaporation unit, such as the last effect of the multiple-effect evaporation unit. In some embodiments, process integration includes using vapor recompression and vacuum pumping to concentrate the fermentation product, to minimize cooling water requirements.

In some embodiments, process integration includes concentrating one or more organic waste streams and combusting the one or more organic waste streams with lignin or another biomass-derived material.

In some embodiments, process integration includes utilizing a rectifier reflux condensor to pre-evaporate stillage from a fermentation product distillation column. The process integration may also include preheating dimineralized water or preheating turbine condenser condensate, for example.

When lignosulfonic acid is utilized, either to assist the initial extraction or for hydrolysis of hemicellulose oligomers to monomers, the lignosulfonic acid may be provided by another biorefining process. For example, the AVAP® process employs sulfur dioxide and a solvent for lignin to fractionate biomass, which produces lignosulfonic acids during digestion.

The present invention, in various embodiments, offers several benefits including but not limited to (i) increased yield of pulp, (ii) utilization of hemicelluloses, (iii) removal of chemicals from the pulping process, (iv) elimination of chemical-recovery plant operations, (v) elimination of washing units; (vi) reduction in number of evaporation stages required, and (vii) reduced environmental footprint.

The present invention also provides systems configured for carrying out the disclosed processes, and compositions or products produced therefrom. Biorefineries may be configured to carry out the processes disclosed using known equipment. The biorefineries may be retrofits to existing mills, or new sites.

Any stream generated by the disclosed processes may be partially or completed recovered, purified or further treated, and/or marketed or sold.

In this detailed description, reference has been made to multiple embodiments of the invention and non-limiting examples relating to how the invention can be understood and practiced. Other embodiments that do not provide all of the features and advantages set forth herein may be utilized, without departing from the spirit and scope of the present invention. This invention incorporates routine experimentation and optimization of the methods and systems described herein. Such modifications and variations are considered to be within the scope of the invention defined by the claims.

All publications, patents, and patent applications cited in this specification are hereby incorporated by reference in their entirety as if each publication, patent, or patent application were specifically and individually put forth herein.

Where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially.

Therefore, to the extent there are variations of the invention, which are within the spirit of the disclosure or equivalent to the inventions found in the appended claims, it is the intent that this patent application will cover those variations as well.

What is claimed is:

1. A process for producing a paper product from biomass, said process comprising:

(a) providing lignocellulosic biomass comprising cellulose, hemicellulose, and lignin;

(b) digesting said biomass in the presence of steam and/or hot water to generate an intermediate pulp material and a liquid phase, wherein said liquid phase contains extracted hemicelluloses and lignin;

(c) evaporating said liquid phase to remove volatile components, thereby generating a solids-enriched liquid phase;

(d) mechanically refining said intermediate pulp material, to generate a refined pulp material; and (e) introducing said refined pulp material, said solids-enriched liquid phase, and optionally a separate solid material to a paper machine, to produce a paper product, wherein said process further comprises washing said liquid phase from said intermediate pulp material using an aqueous wash solution, to generate an intermediate pulp material wash filtrate, and evaporating said intermediate pulp material wash filtrate to remove volatile components, thereby generating a solids-enriched intermediate pulp material wash filtrate; wherein said solids-enriched intermediate pulp material wash filtrate is introduced to said paper machine.

2. The process of claim 1, wherein step (b) is conducted using said steam in saturated, superheated, or supersaturated form.

3. The process of claim 1, wherein step (b) is conducted using hot water.

4. The process of claim 1, wherein step (b) is conducted at a digestor temperature selected from about 140° C. to about 220° C.

5. The process of claim 1, wherein step (b) is conducted at a digestor residence time selected from about 1 minute to about 60 minutes.

6. The process of claim 1, wherein said refined pulp material is not separately washed.

7. A process for producing a paper product from biomass, said process comprising:

(a) providing lignocellulosic biomass comprising cellulose, hemicellulose, and lignin;

(b) digesting said biomass in the presence of steam and/or hot water to generate an intermediate pulp material and a liquid phase, wherein said liquid phase contains extracted hemicelluloses and lignin;

(c) evaporating said liquid phase to remove volatile components, thereby generating a solids-enriched liquid phase;

(d) mechanically refining said intermediate pulp material, to generate a refined pulp material; and (e) introducing said refined pulp material, said solids-enriched liquid phase, and optionally a separate solid material to a paper machine, to produce a paper product, wherein said process further comprises washing said liquid phase from said refined pulp material using an aqueous wash solution, to generate a refined pulp material wash filtrate, and evaporating said refined pulp material wash filtrate to remove volatile components, thereby generating a solids-enriched refined pulp material wash filtrate;

wherein said solids-enriched refined pulp material wash filtrate is introduced to said paper machine.

8. The process of claim 7, wherein step (b) is conducted using said steam in saturated, superheated, or supersaturated form.

9. The process of claim 7, wherein step (b) is conducted using hot water.

10. The process of claim 7, wherein step (b) is conducted at a digestor temperature selected from about 140° C. to about 220° C.

11. The process of claim 7, wherein step (b) is conducted at a digestor residence time selected from about 1 minute to about 60 minutes.

12. The process of claim 7, wherein said intermediate pulp material is not separately washed.

* * * * *